US009425013B2

(12) United States Patent
Augusta et al.

(10) Patent No.: US 9,425,013 B2
(45) Date of Patent: Aug. 23, 2016

(54) MAGNETIC TRIPPING DEVICE AND OVERCURRENT TRIPPING DEVICE OF AN ELECTRICAL SWITCH AND ELECTRICAL SWITCH AND METHOD FOR CALIBRATING THE MAGNETIC TRIPPING OF A MAGNETIC TRIPPING DEVICE

(71) Applicant: Siemens Aktiengesellschaft, Munich (DE)

(72) Inventors: Zbynek Augusta, Letohrad (CZ); Frank Himmelein, Weidenbach (DE); Filip Musil, Zachlumi (CZ)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 21 days.

(21) Appl. No.: 14/572,830

(22) Filed: Dec. 17, 2014

(65) Prior Publication Data

US 2015/0243462 A1 Aug. 27, 2015

(30) Foreign Application Priority Data

Feb. 21, 2014 (DE) ..... 10 2014 203 161 U

(51) Int. Cl.

| | |
|---|---|
| ***H01H 9/00*** | (2006.01) |
| ***H01H 50/64*** | (2006.01) |
| ***H01H 50/18*** | (2006.01) |
| ***H01H 71/24*** | (2006.01) |
| *H01H 71/40* | (2006.01) |

(52) U.S. Cl.

CPC ..... *H01H 50/64* (2013.01); *H01H 50/18* (2013.01); *H01H 71/2472* (2013.01); *H01H 71/40* (2013.01); *H01H 2071/407* (2013.01)

(58) Field of Classification Search

CPC ..... H01H 50/64; H01H 50/18; H01H 77/06; H01H 89/00; H01H 71/40; H01H 71/2472; H01H 73/48; H01H 73/50; H01H 2071/042

USPC ..... 335/175

See application file for complete search history.

(56) References Cited

U.S. PATENT DOCUMENTS

| | | | | |
|---|---|---|---|---|
| 1,976,781 | A * | 10/1934 | Graves, Jr. | H01H 73/50 335/144 |
| 2008/0122563 | A1* | 5/2008 | Song | H01H 71/7463 335/176 |
| 2013/0187735 | A1* | 7/2013 | Augusta | H01H 77/06 335/18 |
| 2013/0187746 | A1* | 7/2013 | Augusta | H01H 89/00 337/3 |
| 2013/0271257 | A1* | 10/2013 | Yang | H01H 77/04 337/37 |

* cited by examiner

*Primary Examiner* — Shawki S Ismail
*Assistant Examiner* — Lisa Homza
(74) *Attorney, Agent, or Firm* — Harness, Dickey & Pierce, P.L.C.

(57) ABSTRACT

An overcurrent tripping device of an electrical switch for interrupting a current flow in an electrical circuit in the event of the occurrence of an overload or a short circuit is disclosed. In an embodiment, the overcurrent tripping device includes a thermal tripping device and a magnetic tripping device. A magnetic tripping device is disclosed which, in an embodiment, includes at least one yoke element for generating a magnetic field, an armature element responding to the magnetic field, and a spring element. The armature element is arranged on an armature carrier element, separated from the yoke element, by way of a first armature element end and is mounted pivotably about an armature element rotation axis. In addition, an electrical switch including an overcurrent tripping device, and a method for calibrating magnetic tripping of a magnetic tripping device of an electrical switch, are disclosed.

12 Claims, 4 Drawing Sheets

MAGNETIC TRIPPING DEVICE AND OVERCURRENT TRIPPING DEVICE OF AN ELECTRICAL SWITCH AND ELECTRICAL SWITCH AND METHOD FOR CALIBRATING THE MAGNETIC TRIPPING OF A MAGNETIC TRIPPING DEVICE

PRIORITY STATEMENT

The present application hereby claims priority under 35 U.S.C. §119 to German patent application number DE 102014203161.3 filed Feb. 21, 2014, the entire contents of which are hereby incorporated herein by reference.

FIELD

At least one embodiment of the present invention generally relates to a magnetic tripping device of an electrical switch for interrupting a current flow in an electrical circuit in the event of the occurrence of a short circuit and to an overcurrent tripping device of an electrical switch in the case of the occurrence of an overload or a short circuit. In addition, at least one embodiment of the present invention generally relates to an electrical switch and in particular to an electrical circuit breaker interrupting a current flow in an electrical circuit in the event of the occurrence of an overload or a short circuit and to a method for calibrating magnetic tripping of a magnetic tripping device.

BACKGROUND

In principle, it is known that compact circuit breakers (MCCB=Molded Case Circuit Breakers) are designed in accordance with the principle of the magnetic repulsion of contacts, for example. In this case, the contacts open before the expected peak value of the short-circuit current is reached. Owing to the magnetic repulsion of the contacts, the thermal loading and the mechanical loading as a result of the sudden short-circuit current of the system components which can occur during a short circuit are reduced considerably.

A compact circuit breaker is used, for example, for realizing a dual function, namely protection of a system from overload and short-circuit currents and protection of lines and electrical operating devices from damage as a result of ground faults, for example. In order to protect a system from overload currents or short-circuit currents, the compact circuit breaker, which can also be referred to as thermal-magnetic circuit breaker, has a thermal-magnetic trip unit (TMTU). The thermal-magnetic trip unit has a thermal tripping device in order to protect the electrical circuit or an electrical device from damage owing to an overload, and a magnetic tripping device in order to protect the electrical circuit or an electrical device from damage owing to a short circuit.

A short circuit and in particular an electrical short circuit is generally known as an accidental or unintentionally arising conductive connection between two or more conductive parts and primarily between two nodes of the electrical circuit, as a result of which the electrical potential differences between these conductive parts drop to a value equal to zero or close to zero. In particular in relation to a compact circuit breaker, a short circuit is an abnormal connection between two isolated phases, which are intended to be isolated or insulated from one another. A short circuit results in the presence of an excessive electrical current, namely an overcurrent, which can result in damage, overheating, fire or even an explosion of the electrical circuit and/or the consumer. An overload is a less extreme state in comparison with a short circuit and is rather a longer-term overcurrent state.

The thermal tripping device has, for example, a bimetallic strip including two metal strips which are rolled one on top of the other, which metal strips have different coefficients of thermal expansion. The current of the connected consumer in this case flows via a heating winding and heats up the bimetallic strip, which then bends or curves. Owing to the bending movement of the bimetallic strip, control contacts are actuated, for example, or a latching mechanism of a circuit breaker is unlatched.

The magnetic tripping device or the electromagnetic tripping device is constructed, for example, in such a way that, in the event of the occurrence of a short circuit or a short-circuit current, the current flowing through a coil of the electromagnetic tripping device is so high that, for example, an impact armature or a hinged armature is attracted and, owing to this movement, a latching mechanism of the circuit breaker unlatches without delay. For this purpose, known electromagnetic tripping devices also have a yoke or yoke element, for example, which is arranged along or around an electrical line or a current-conducting path in order to generate a magnetic field in the event of the occurrence of a short-circuit current, which magnetic field advantageously attracts the armature element. The armature element or the armature is held in position in a known manner by a spring and in particular a tension spring, with the result that a movement of the armature element in the direction of the yoke element counter to the tensile force or spring force of the spring can therefore only take place in the event of the occurrence of a defined magnetic field and consequently a corresponding tripping short-circuit current.

Compact circuit breakers are preferably power circuit breakers which can be switched on again after tripping owing to an overload or a short-circuit current. In this case, the tripping devices, i.e. the thermal tripping device and the magnetic tripping device, are advantageously arranged in series.

Depending on the use conditions and/or use location of the compact circuit breaker and in particular taking into consideration different rated currents or tripping characteristics and/or on the basis of the resistance to faulty tripping as a result of transient voltages and the time delay in the presence of a fault current, it is therefore indispensable to calibrate or set the magnetic tripping of the armature so that the armature is attracted only in the case of the occurrence of a defined short-circuit current owing to the magnetic field generated by the yoke element. For this purpose, in a known manner the spring force acting on the armature element is changed, wherein primarily the corresponding spring element, having a corresponding spring force, is mounted. This requires the use of a large number of different spring element types or a large number of springs with a different spring force.

Furthermore, it is considered disadvantageous that the armature element is mounted movably in a known manner by virtue of holding regions or projections of the yoke element, with the result that, in particular in the event of the occurrence of a short-circuit current, more than one magnetic field, and in particular two magnetic fields, are generated by the yoke element, which magnetic fields negatively influence one another, and in particular impair one another, and therefore also negatively influence and in particular impair the movement of the armature element with respect to the yoke element. Therefore, it is conceivable that sufficiently quick tripping of the movement of the armature element for interruption of the current flow in the electrical circuit cannot be realized.

SUMMARY

At least one embodiment of the present invention therefore resides in at least partially eliminating at least one of the above-described disadvantages in the case of an electrical switch and in particular an electrical circuit breaker, such as a compact circuit breaker. In particular, at least one embodiment of the present invention is directed to a magnetic tripping device, an overcurrent tripping device and an electrical switch and a method for calibrating magnetic tripping of a magnetic tripping device of an electrical switch, by which an arrangement of the armature element with respect to the yoke element and simple setting of the armature torque taking into consideration, for example, a rated current intensity of the electrical current take place in a simple and inexpensive manner.

At least one embodiment is directed to a magnetic tripping device of an electrical switch for interrupting a current flow in an electrical circuit in the event of the occurrence of a short circuit and/or by an overcurrent tripping device of an electrical switch for interrupting a current flow in an electrical circuit in the event of the occurrence of an overload or a short circuit. In addition, at least one embodiment is directed to an electrical switch for interrupting a current flow in an electrical circuit in the event of the occurrence of an overload or a short circuit and/or a method for calibrating magnetic tripping of a magnetic tripping device of an electrical switch. Further features and details of the invention result from the dependent claims, the description and the drawings. In this case, features and details which are described in connection with the magnetic tripping device do of course also apply in connection with the overcurrent tripping device according to embodiments of the invention or the electrical switch according to embodiments of the invention or the method according to embodiments of the invention for calibrating the electrical switch, and vice versa in each case, with the result that reference is or can always be made alternately to the individual aspects of embodiments of the invention with respect to the disclosure.

In addition, in order to implement the method according to embodiments of the invention, a magnetic tripping device according to embodiments of the invention, an overcurrent tripping device according to embodiments of the invention and/or an electrical switch according to the embodiments of invention can be used.

The magnetic tripping device according to embodiments of the invention of an electrical switch for interrupting a current flow in an electrical circuit in the event of the occurrence of a short circuit has at least one yoke element for generating a magnetic field depending on a current intensity of an electrical current flowing through a current-conducting element, an armature element responding movably to a change in magnetic field, and a spring element, which defines a current threshold value for the movement of the armature element. In accordance with embodiments of the invention, the armature element is arranged on an armature carrier unit, which is separated from the yoke element, by means of a first armature element end and is mounted pivotably about an armature element rotation axis.

BRIEF DESCRIPTION OF THE DRAWINGS

A magnetic tripping device of embodiments of a tripping unit according to embodiments of the invention or embodiments of an overcurrent tripping device according to embodiments of the invention will be explained in more detail below with reference to drawings, in which, in each case schematically.

Elements having an identical function and mode of operation are provided with the same reference symbols in each case in FIGS. 1 to 4.

DETAILED DESCRIPTION OF THE EXAMPLE EMBODIMENTS

Figure 1:
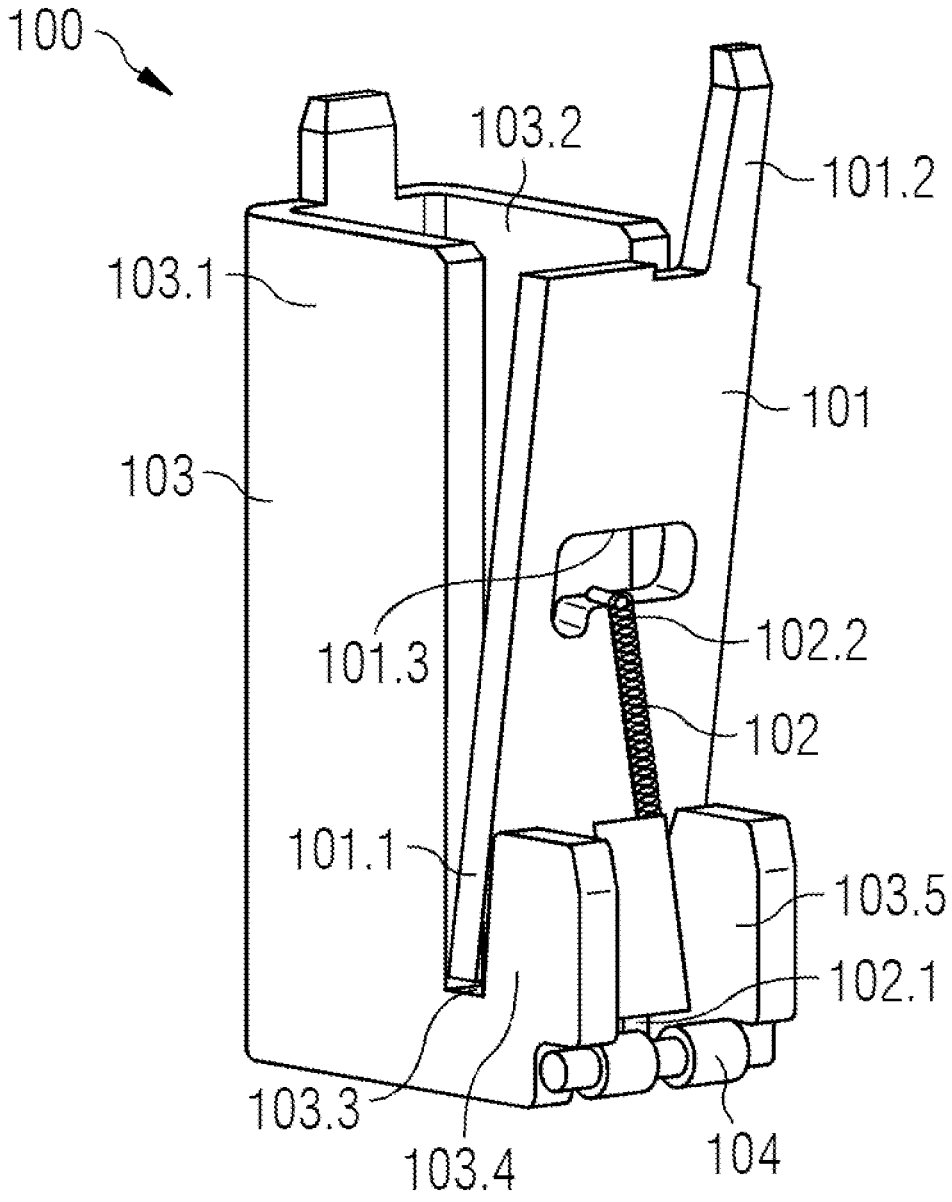
FIG 1 Prior art
FIG. 1 shows a perspective view of an embodiment of a magnetic tripping device known from the general prior art.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

At least one embodiment is directed to a magnetic tripping device of an electrical switch for interrupting a current flow in an electrical circuit in the event of the occurrence of a short circuit and/or by an overcurrent tripping device of an electrical switch for interrupting a current flow in an electrical circuit in the event of the occurrence of an overload or a short circuit. In addition, at least one embodiment is directed to an electrical switch for interrupting a current flow in an electrical circuit in the event of the occurrence of an overload or a short circuit and/or a method for calibrating magnetic tripping of a magnetic tripping device of an electrical switch. Further features and details of the invention result from the dependent claims, the description and the drawings. In this case, features and details which are described in connection with the magnetic tripping device do of course also apply in connection with the overcurrent tripping device according to embodiments of the invention or the electrical switch according to embodiments of the invention or the method according to embodiments of the invention for calibrating the electrical switch, and vice versa in each case, with the result that reference is or can always be made alternately to the individual aspects of embodiments of the invention with respect to the disclosure.

In addition, in order to implement the method according to embodiments of the invention, a magnetic tripping device according to embodiments of the invention, an overcurrent tripping device according to embodiments of the invention and/or an electrical switch according to the embodiments of invention can be used.

The magnetic tripping device according to embodiments of the invention of an electrical switch for interrupting a current flow in an electrical circuit in the event of the occurrence of a short circuit has at least one yoke element for generating a magnetic field depending on a current intensity of an electrical current flowing through a current-conducting element, an armature element responding movably to a change in magnetic field, and a spring element, which defines a current threshold value for the movement of the armature element. In accordance with embodiments of the invention, the armature element is arranged on an armature carrier unit, which is separated from the yoke element, by means of a first armature element end and is mounted pivotably about an armature element rotation axis.

Advantageously, the magnetic tripping device is part of an electrical circuit breaker and in particular a compact circuit breaker, which has the magnetic tripping device and a thermal tripping device. The electrical circuit breaker or compact circuit breaker or power circuit breaker is an overcurrent circuit breaker or an overcurrent protection device, which can be switched on again advantageously after tripping owing to an overload or a short-circuit current. The magnetic tripping device of the electrical switch in this case advantageously serves the purpose of interrupting the current flow in an electrical circuit in the event of the occurrence of a short-circuit current, while a thermal tripping device of the electrical switch, for example, serves the purpose of interrupting the current flow in an electrical circuit in the event of the occurrence of an overload. During interruption of a current flow in an electrical circuit, in this case in particular an electrical consumer which consumes electric current or energy is isolated from the circuit or a feed line for feeding electrical energy in order to prevent damage to the electrical consumer or the electrical load.

Advantageously, the armature element has two armature element ends, which extend along an armature element longitudinal axis. The first armature element end, which is in particular a first distal armature element end, is in this case advantageously arranged on an armature carrier unit in such a way that the armature element can pivot or rotate about an armature element rotation axis or a rotation axis or a center of rotation in the region of the first armature element end. In this case, in particular an armature element longitudinal axis is pivoted about the rotation axis or the center of rotation. The second armature element end, which is opposite the first armature element end, is advantageously connected to a spring element, wherein the spring element extends from the armature element in the direction towards the armature carrier unit.

The first armature element end and/or the second armature element end are in this case either the distal ends of the armature element or can extend, starting from the distal armature element ends, in the direction towards the central region of the armature element, with the result that an end region of the armature element can also be understood to be a first and/or second armature element end. Advantageously, the armature element longitudinal axis extends substantially in the same direction as the spring element longitudinal axis, namely substantially in a vertical direction. Accordingly, the spring element, which may be, for example, a tension spring or a spiral spring or a comparable resilient element, has at least two spring element ends, wherein the second spring element end is arranged on the armature element and in particular in a region of the second armature element, while the first spring element end is arranged on an armature carrier unit.

The armature carrier unit, which advantageously serves the purpose of mounting and also positioning the armature element with respect to the yoke element, is a component part which is separated from the yoke element and which is advantageously also arranged spaced apart from the yoke element. In this case, it is conceivable for the yoke element not to be in contact with the armature carrier unit at all, or at least only to be in contact sectionally.

Advantageously, the yoke element has a material composition which is different than that of the armature carrier unit. The armature element rotation axis advantageously extends orthogonal to the armature element longitudinal axis and/or the spring element longitudinal axis. The term current threshold value, which can also be referred to as current intensity threshold value, is understood within the scope of the invention to mean the threshold value which needs to be reached by the electric current flowing through the current-conducting element in order to trip the armature element or trigger a movement of the armature element.

Within the scope of embodiments of the invention, it is conceivable for the armature carrier unit to have an adjusting element which interacts with the spring element. In particular, the armature carrier element has an adjusting element which interacts with a first spring element end of the spring element. Within the scope of embodiments of the invention, the term interaction means a relationship between the spring element and the adjusting element whereby the spring element and adjusting element share an interdependence with one another or a relationship with respect to one another. This means that, in the case of an interaction of the adjusting element, the spring element also acts in a predefined or predefinable way. Advantageously, the adjusting element is fixed movably on the armature carrier unit or arranged thereon.

Within the scope of embodiments of the invention, it is conceivable for the adjusting element to be an adjusting screw. It is furthermore possible for the adjusting element to be an adjusting pin or a comparable component part. The adjusting element longitudinal axis advantageously extends substantially orthogonal to a spring element longitudinal axis of the spring element, wherein the adjusting element is in particular adjustable along the adjusting element longitudinal axis. If, therefore, the adjusting element is an adjusting pin, it is conceivable for the adjusting pin to be movable along the pin longitudinal axis in order to effect a change of position, in particular of the first spring element end. If the adjusting element is embodied in the form of an adjusting screw, for example, it is possible for this adjusting screw to engage, for example with an external thread, in an internal thread in an opening in the armature carrier unit and therefore being capable of being moved along an adjusting screw longitudinal axis, as a result of which, in turn, the spring element and in particular the first end of the spring element or the first spring element end can advantageously be moved along the adjusting element longitudinal axis.

Within the scope of embodiments of the invention, it is furthermore conceivable for the armature carrier unit to have an armature holding element for mounting the armature element. In this case, the term mounting is understood to mean a stop and in particular a movement limit and also positioning and rotatable holding of the armature element. The mounting of the armature element by way of the armature holding element of the armature carrier unit advantageously serves the purpose of allowing the armature element to pivot or rotate only about a defined armature element center of rotation or about an armature element rotation axis, wherein, at the same time, a longitudinal movement, which means a movement in the direction of the armature element longitudinal axis, and/or a transverse movement, which means a movement orthogonal to the armature element longitudinal axis, of the armature element is avoided.

Advantageously, at the same time the armature holding element serves the purpose of limiting the movement of the armature element about its center of rotation or about its rotation axis, with the result that, independently of the tensile force of the spring element arranged on the armature element, a maximum spacing of the armature element from the yoke element can be provided. It is conceivable for the armature carrier element to have at least the armature holding element and preferably also the adjusting element. In this case, the armature holding element is configured in such a way that a rotatable mounting of the armature element with respect to the yoke element in defined regions can be made possible, wherein, at the same time, an arrangement and guidance for the adjusting element is formed. Accordingly, it is possible for the armature carrier unit and in particular the armature holding element to have at least one through-bore with an internal thread in order to accommodate an adjusting element and in particular an adjusting screw with an external thread.

Advantageously, it is conceivable for the armature carrier unit to be positionable variably with respect to the yoke element. Variable positioning of the armature carrier unit with respect to the yoke element is particularly advantageous when the yoke element itself is variable in respect of its configuration and/or also in respect of its positioning within the magnetic tripping device. It is thus conceivable for the armature carrier unit to be capable of being arranged or positioned with respect to the yoke element variably at least along a current-conducting element and in particular a section of the current-conducting element, taking into consideration a configuration and/or position of said yoke element.

Advantageously, the armature carrier unit can be arranged at least in two different positions along the current-conducting element, which advantageously extends through the magnetic tripping device. In addition, it is conceivable for the armature carrier unit to be connected undetachably to the current-conducting element in a defined position, and in particular to be soldered or riveted thereto or to be fixed by way of a clinch connection to the current-conducting element.

It is furthermore possible for at least the armature holding element to comprise a nonmagnetic material. It is thus also conceivable, for example, for the armature holding element to advantageously completely consist of a nonmagnetic material. It is likewise possible for not only the armature holding element itself, but also the entire armature carrier unit to comprise a nonmagnetic material and in particular to completely consist of a nonmagnetic material. Advantageously, owing to the use of a nonmagnetic material in the manufacture of the armature holding element or the armature carrier unit, the possibility of a second magnetic field which can negatively influence or impair the first magnetic field, generated by the yoke element, is prevented from being generated. Advantageously, therefore, only a single magnetic field is generated, which magnetic field enables or initiates tripping of the armature element and in particular a movement of the armature element about the armature element rotation axis thereof in the direction towards the yoke element.

Advantageously, a simple and quick orientation and/or arrangement of the armature element with respect to the yoke element and in particular with respect to differently configured yoke elements is made possible by way of the magnetic tripping device according to embodiments of the invention and in particular by way of the armature carrier unit of the magnetic tripping device according to embodiments of the invention. In conjunction with the use of the adjusting element, therefore, precise setting of the magnetic tripping of the magnetic tripping device can be realized. In addition, a lower number of spring element types is advantageously required for setting different tripping characteristics of the magnetic tripping device, with the result that, owing to this reduction in the number of parts, the risk of confusion between parts during fitting of the magnetic tripping device is reduced and, as a result, the production costs can be reduced.

Furthermore, an overcurrent tripping device of an electrical switch for interrupting a current flow in an electrical circuit in the event of the occurrence of an overload or a short circuit is disclosed. The overcurrent tripping device according to embodiments of the invention has a thermal tripping device for interrupting the current flow in the event of an overload and a magnetic tripping device for interrupting the current flow in the event of a short circuit. The magnetic tripping device is configured as set forth above. The thermal tripping device of the overcurrent tripping device advantageously has a bimetallic element, which is, for example, a metal strip including two layers of different metals, which are connected to one another cohesively or in a form-fitting manner. In this case, however, it is also conceivable for more than two layers, in particular three layers in the form of a trimetallic strip or else four layers in the form of a tetrametallic strip, etc., to be connected to one another. The form of the bimetallic strip or trimetallic strip or tetrametallic strip changes owing to a change in temperature, wherein the bimetallic strip, which can also be referred to as a thermal bimetallic strip, is bent or deformed.

The cause of this bending is the different coefficients of thermal expansion of the metals of the bimetallic strip which are used and which are connected to one another. Such metals can be, for example, zinc and steel or else steel in combination with an alloy, such as brass, for example. The bimetallic strip advantageously has a first end, which is arranged on a region of the current-conducting element, with the result that thermal energy output by the current-conducting element can be absorbed at least indirectly by the bimetallic element. Thermal energy is caused in particular by an electric current flowing through the current-conducting element.

In the event of the occurrence of a tripping moment, such as in particular an overload, the current-conducting element is heated, with the result that, increasingly, thermal energy is output to the bimetallic strip, as a result of which the bimetallic strip bends, in particular in the direction of a tripping element, owing to the different coefficients of thermal expansion of the metals in the bimetallic strip. The tripping element is a component or a component part of the tripping mechanism of the electrical switch or of the electrical circuit breaker and in particular of the compact circuit breaker. The tripping element can be configured, for example, in the form of a shaft or a slide and is moved, owing to contact being made with the bimetallic element, in such a way that an electrical circuit is interrupted in such a way that the electric current can no longer flow to a consumer, for example. As a result, the consumer is protected from damage as a result of an overload.

In order to protect the consumer from damage owing to a short circuit, the overcurrent tripping device has a magnetic tripping device of the type described above.

In the case of the overcurrent tripping device described, all of the advantages which have been described already with respect to a magnetic tripping device in accordance with the first aspect of an embodiment of the invention result.

Furthermore, an electrical switch is disclosed, in particular an electrical circuit breaker, for interrupting a current flow in an electrical circuit in the event of the occurrence of an overload or a short circuit, having at least one overcurrent tripping device. As a result, the electrical switch, which can in particular be in the form of a compact circuit breaker, has an overcurrent tripping device, which in particular has a thermal tripping device for interrupting the current flow in the event of an overload and a magnetic tripping device for interrupting the current flow in the event of a short circuit. Advantageously, at least the magnetic tripping device has a configuration as described above.

In the case of the electrical switch described, all of the advantages which have already been described with respect to a magnetic tripping device and/or an overcurrent tripping device in accordance with the previous aspects of embodiments of the invention result.

Furthermore, a method for calibrating magnetic tripping of a magnetic tripping device of an electrical switch is disclosed. In accordance with the method according to an embodiment the invention, an armature carrier unit for rotatably mounting an armature element about an armature element rotation axis taking into consideration an arrangement and/or configuration of a yoke element for generating a magnetic field is positioned variably with respect to the yoke element. In accordance with embodiments of the invention, it is possible for, in addition or as an alternative, an adjusting element of an armature carrier unit for rotatably mounting an armature element about an armature element rotation axis to be moved along an adjusting element axis and in particular an adjusting element longitudinal axis, with the result that at least one position of at least one spring element end of a spring element connected to the adjusting element is varied in order to set a current threshold value.

Within the scope of the invention, the current threshold value is the threshold value that the electric current flowing through a current-conducting element needs to reach in order to trip the armature element or to trigger a movement of the armature element or to generate a defined magnetic field at the yoke element. If, therefore, an excessive, i.e. an abnormally high, electric current is flowing through the current-conducting element, as a result a defined current threshold value is thus exceeded, as a result of which, in turn, a magnetic field with a defined magnetic field strength is generated by way of the yoke element, so that the armature element is moved in the direction of the yoke element owing to the magnetic field generated and, as a result, attracted by the electrical magnetic field.

Accordingly, it is possible to set different current threshold values by way of the adjusting element, as a result of which, in turn, the armature element, owing to magnetic fields generated of different strengths and corresponding to a different current intensity of the electric current flowing through the current-conducting element, is pivoted about an armature element rotation axis. Owing to the movement of the armature element, a tripping mechanism is activated, by which the current flow in the electric circuit is interrupted, with the result that a consumer of electrical energy is advantageously isolated from the electrical circuit in order to prevent damage to this consumer. An increase in the electric current is triggered, for example, by an overload or a short circuit, wherein the magnetic tripping device in particular responds to the tripping moment of the short circuit, while in particular the thermal tripping device responds to the tripping moment of the overload.

In order thus to calibrate or set the magnetic tripping of the magnetic tripping device, it is therefore conceivable for the armature carrier unit to firstly be positioned variably with respect to the yoke element, in particular taking into consideration an arrangement and/or a configuration of said yoke element, wherein the armature carrier unit can in particular be shifted along a current-conducting element, with the result that the spacing between the armature carrier unit and the yoke element can be varied variably.

Differently configured yoke elements are used in order for it to be possible to generate a defined magnetic field, based on different rated currents of the electrical circuit. This means that, in particular in the case of the presence of a relatively low rated current of the electrical circuit, the yoke element needs to be configured such that a strong and in particular forceful magnetic field is generated in order to deflect or move the armature element in the direction towards the yoke element. The magnetic fields which can be generated corresponding to the different rated currents are generated by way of a different configuration or form of the yoke element. It is thus conceivable for the yoke element and in particular a clamp of the yoke element to have the possibility of having a cubic or square form, for example, or else a trapezoidal form.

Accordingly, it is necessary to arrange or orientate the armature carrier unit at a defined spacing from the yoke element, in particular along a current-conducting element, taking into consideration the form and/or the size of the yoke element. After positioning of the armature carrier unit with respect to the yoke element, it is possible for this armature carrier unit to be connected, advantageously undetachably, to the current-conducting element by virtue of the armature carrier unit being riveted to the current-conducting element, for example. As a result, an undesired movement of the armature carrier unit with respect to the yoke element, in particular during a tripping moment, is advantageously avoided.

For example in order to finely adjust the magnetic tripping of the magnetic tripping device, it is furthermore conceivable for a spring element end and in particular the first spring element end of a spring element which interacts with the armature element, to be adjusted. For this purpose, the first spring element end is moved along an adjusting element axis and in particular the adjusting element longitudinal axis in the direction towards the adjusting element holding region for holding or positioning or guiding the adjusting element, or in the direction of the armature element.

As a result, it is firstly conceivable to change, and in particular to increase or reduce, the spring force of the spring element. Secondly, it is alternatively or additionally conceivable to change, and in particular to increase or to reduce, a torque acting about the armature element rotation axis of the armature element owing to the change in spacing between the armature element and the first spring element end.

The armature element, which has two armature element ends, wherein the first armature element end is arranged rotatably on the armature carrier unit, and the second armature element end is connected to a second spring element end of the spring element, is advantageously arranged in a defined initial position owing to the spring force or the spring prestress of the spring element. The first spring element end of the spring element is advantageously connected to an adjusting element, wherein the adjusting element is advantageously a component of the armature carrier unit. The adjusting element, which is, for example, an adjusting pin or an adjusting screw, can be moved with respect to the armature holding element. The armature holding element advantageously serves the purpose of mounting the armature element or of positioning the armature element in a defined position and preventing an undesired movement of the armature element, with the result that the armature holding element can additionally also be used as stop element for the armature element.

In the case of an adjustment of the adjusting element with respect to the armature holding element, the spring force of the spring element, which is advantageously a tension spring, can be changed as a result, wherein the spring force can be increased or else reduced. The adjusting element advantageously has an adjustment element axis, which can be configured in the form of a rotation axis and in particular of an adjusting element longitudinal axis, for example. The first spring element end is therefore moved along the adjusting element axis.

Owing to the movement of the spring element end along the adjusting element axis, the spring force and in particular the spring prestress force of the spring element is accordingly increased or reduced. However, it is also conceivable for the spring force of the spring element to remain virtually unchanged, in particular when, during the adjustment of the first spring element end along the adjusting element longitudinal axis, the armature element is pivoted about the armature element rotation axis in the direction towards the spring element.

In this case, however, the spacing between the first spring element end and the armature element and in particular the first armature element end is changed. Owing to this change in spacing, therefore, a lever of the armature element can be adjusted or a torque of the armature element about its rotation axis or about its center of rotation can be adjusted or set. In physics or engineering, a lever is therefore understood to mean a mechanical force converter, which includes a rigid body which is fastened rotatably on a fulcrum. As a result, in particular by virtue of the setting of the lever and/or the spring force of the spring element, the torque of the armature element about its armature element rotation axis is adjusted or set.

Advantageously, a magnetic tripping device of an embodiment is used in the method according to embodiments of the invention. Therefore, it is conceivable to use a magnetic tripping device of the preceding type in the method according to embodiments of the invention.

In the method described, all of the advantages which have already been described with respect to a magnetic tripping device, an overcurrent tripping device and/or an electrical switch in accordance with the preceding aspects of embodiments of the invention result.

FIG. 1 shows a perspective view of a known magnetic tripping device 100. The magnetic tripping device 100 has an armature element 101, a spring element 102 and a yoke element 103. The yoke element 103 is shaped in such a way that the individual yoke clamps 103.1 and 103.2 have cutouts 103.3 or hook-shaped projections 103.4 and 103.5, by means of which holding regions for arranging the armature element 101 on the yoke element 103 are formed. The armature element 101 is therefore arranged on the yoke element 103 itself and connected movably to this yoke element 103. The spring element 102 engages with a first spring element end 102.1 into a cross pin 104, which extends in a lower region of the yoke element 103. With a second spring element end 102.2, the spring element 102 engages in an engagement region 101.3 of the armature element 101, which is formed between a first armature element end 101.1 and a further armature element end 101.2.

Accordingly, the armature element 101 is held or prestressed in a defined position by way of the spring element 102. Depending on the use of a specific type of spring element 102, a defined spring element prestressing force is applied to the armature element 101, with the result that, when an electrical magnetic field is generated in the yoke element 103, a movement of the armature element 101 in the direction towards the yoke element 103 is made possible, taking into consideration the intensity of the magnetic field generated. This means that, when using a spring element 102 with a high spring force, the armature element 101 is only moved in the direction towards the yoke element 103 when a very strong magnetic field is generated by the yoke element 103.

Accordingly, when using a spring element 102 with a relatively low spring force, quicker magnetic tripping of the magnetic tripping device 100 and consequently earlier movement of the armature element 101 in the direction towards the yoke element 103 is made possible, owing to a correspondingly weaker magnetic field. In order to adjust the magnetic tripping of the magnetic tripping device 100, therefore, different types of spring elements 102 which have a different spring force need to be used correspondingly, which in turn results in a large number of selectable individual parts in the manufacture of the magnetic tripping device 100.

Furthermore, by virtue of the configuration of the yoke element 103 and by virtue of direct mounting of the armature element 101 on the yoke element 103, negative influencing of the movement of the armature element 101 owing to two magnetic fields formed is produced. This means that, firstly, a first magnetic field is generated between the individual yoke clamps 103.1 and 103.2 of the yoke element 103 in the region which is located on that side of the armature element 101 which is opposite the spring element 102. Meanwhile, a second magnetic field is generated between the individual yoke clamps 103.1 and 103.2 of the yoke element 103 in the region of the hook-like projections 103.4 and 103.5 of the yoke element 103, wherein the hook-like projections 103.4 and 103.5 extend along that side of the armature element 101 on which the spring element 102 is also located. The two magnetic fields generated by the yoke element 103 are influenced negatively in such a way that, for example, delayed tripping or movement of the armature element 101 and consequently delayed interruption of the current flow in the electrical circuit in the event of the occurrence of a tripping moment, such as a short-circuit moment, can take place.

Figure 2:
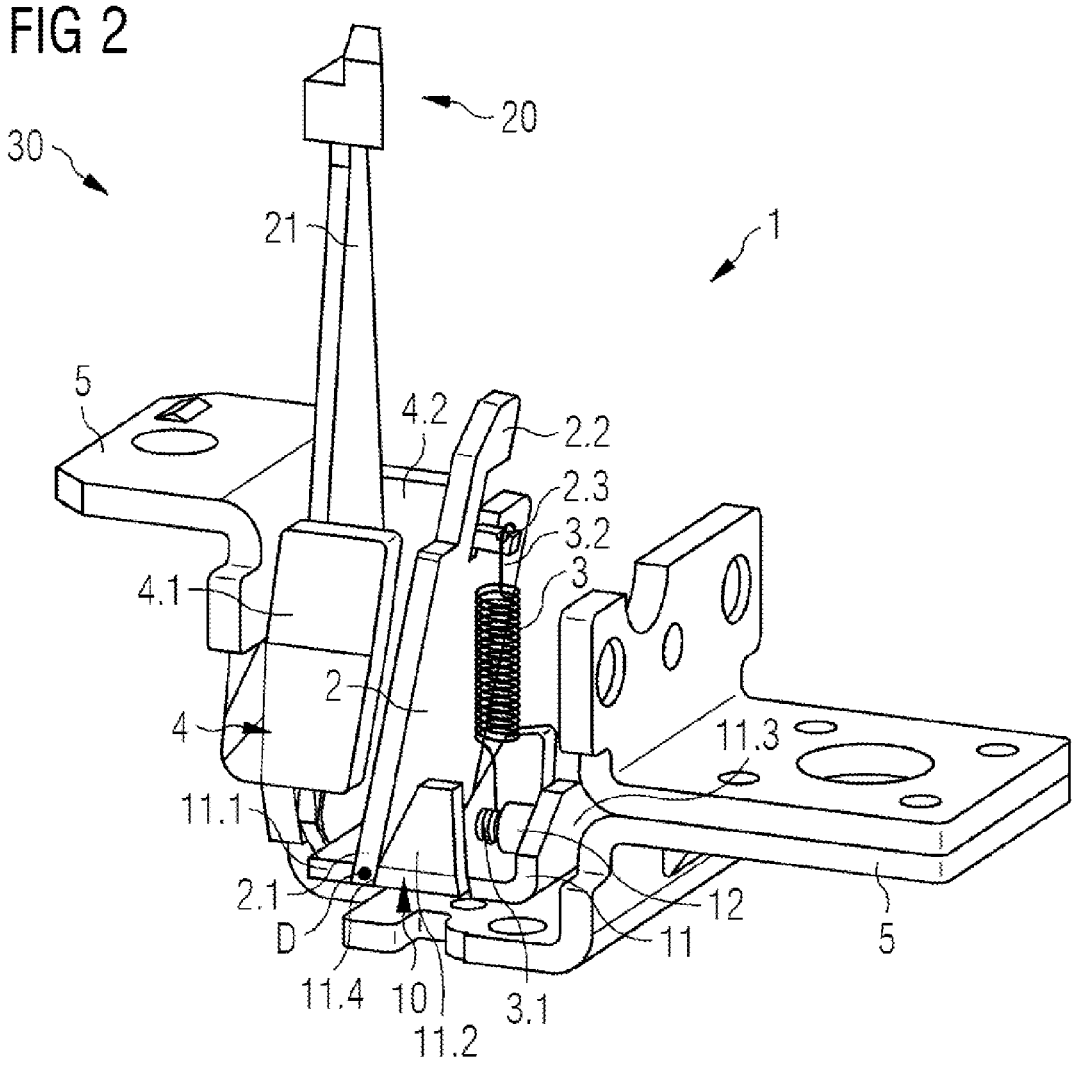
FIG. 2 shows a perspective view of an embodiment of an overcurrent tripping device, having at least one embodiment of a magnetic tripping device.

FIG. 2 shows a perspective view of an embodiment of an overcurrent tripping device 30 according to the invention, having an embodiment of a magnetic tripping device 1 according to the invention. The magnetic tripping device 1 has an armature carrier unit 10, an armature element 2 and a spring element 3 and a yoke element 4. The armature carrier unit 10 itself advantageously has an armature holding element 11 and an adjusting element 12. The yoke element 4 is arranged on a current-conducting element 5, which extends along the magnetic tripping device 1 and also a thermal tripping device 20, shown at least partially here.

Advantageously, the current-conducting element 5 passes through the entire overcurrent tripping device 30 and advantageously has an Ω-shaped (omega-shaped) or U-shaped configuration. The thermal tripping device 20 has a bimetallic element 21, which extends in the region of the yoke element 4 along the current-conducting element 5 and in particular a side limb of the current-conducting element 5. Advantageously, the bimetallic element 21 is arranged between the individual yoke clamps 4.1 and 4.2 of the yoke element 4.

The armature holding element 11 of the armature carrier unit 10 has, by way of example, as shown in FIG. 2, a base region 11.1, which advantageously extends along the current-conducting element 5 and in particular the base region of the current-conducting element 5, which extends between the individual side limbs of the current-conducting element 5. The armature holding element 11 furthermore has a stop region 11.2, which, as shown in FIG. 2, is configured in the form of two clamp regions or projections, which extend substantially perpendicular from the base region 11.1 of the armature holding element 11 in the direction towards a second end 2.2 of the armature element 2.

In addition, the armature holding element 11 has an adjusting element holding region 11.3, which is advantageously arranged in a region on that side of the stop region 11.2 which is opposite the region in which the armature element 2 is arranged on the armature holding element 11. The adjusting element holding region 11.3 is configured in such a way that an adjusting element 12 can be held thereby, wherein, by way of the adjusting element holding region 11.3, advantageously a movement of the adjusting element 12 can be made possible, in particular in the adjusting element longitudinal axis of the adjusting element (cf. for example, FIG. 3).

The base region 11.1 of the armature holding element 11 advantageously has a bearing region 11.4 in the form of a groove or cutout in the base region 11.1, within which the armature element 2 and in particular a first armature element end 2.1 of the armature element 2 is arranged in such a way that the armature element 2 is mounted rotatably or pivotably about an armature element center of rotation D or about an armature element rotation axis D. The armature element rotation axis D advantageously extends along a width of the current-conducting element 5 and therefore substantially orthogonal to an adjusting element longitudinal axis of the adjusting element 12.

The entire armature carrier unit 10 and in particular the armature holding element 11 can be moved along the current-conducting element 5 and in particular along a base region of the current-conducting element 5 with respect to the yoke element 4, with the result that a defined spacing can be realized between the yoke element 4 and the armature carrier unit 10, and in particular the armature element 2, which is arranged on the armature carrier unit 10. The armature element 2 also has an engagement region 2.3, in which in particular a second spring element end 3.2 of the spring element 3 engages. The first spring element end 3.1 of the spring element 3 is in particular arranged on the adjusting element 12.

In particular, the first spring element end 3.1 engages in a corresponding engagement region (not illustrated here) of the adjusting element 12 in such a way that, by virtue of a movement of the adjusting element 12 along the adjusting element longitudinal axis thereof or adjusting element axis, the first spring element end 3.1 can also be moved, at least sectionally, along this adjusting element longitudinal axis. Owing to the movement of the first spring element end 3.1 along the adjusting element longitudinal axis, the spring force of the spring element 3 and/or a spacing between the first spring element end 3.1 and the first armature element end 2.1 is changed and in particular increased or reduced.

That is to say that, taking into consideration the embodiment shown in FIG. 2, in the event of a movement of the spring element end 3.1 in the direction towards the adjusting element holding region 11.3, for example, the spring force of the spring element 3 is changed in such a way that the armature element 2 itself moves in the direction towards the spring element 3 about the armature element center of rotation D of said armature element. As an alternative or in addition, it is possible for a torque of the armature element 2 about the armature element center of rotation D thereof to be changed and in particular increased on the basis of the change in spacing and in particular expansion of the spacing at least between the first spring element end 3.1 and the first armature element end 2.1.

Accordingly, in the event of a movement of the adjusting element 12 such that the first spring element end 3.1 is moved in the direction towards the armature element 2, for example, the spring force of the spring element 3 changes in such a way that the armature element 2 itself moves in the direction towards the yoke element 4 about the armature element center of rotation D of the armature element. As an alternative or in addition, it is possible for a torque of the armature element 2 about its armature element center of rotation D to be changed and in particular reduced on the basis of the change in spacing and in particular minimization of the spacing at least between the first spring element end 3.1 and the first armature element end 2.1. The stop region 11.2 of the armature holding element 11 advantageously serves the purpose of preventing an excessively large deflection of the armature element 2 in the direction towards the adjusting element 12.

Figure 3:
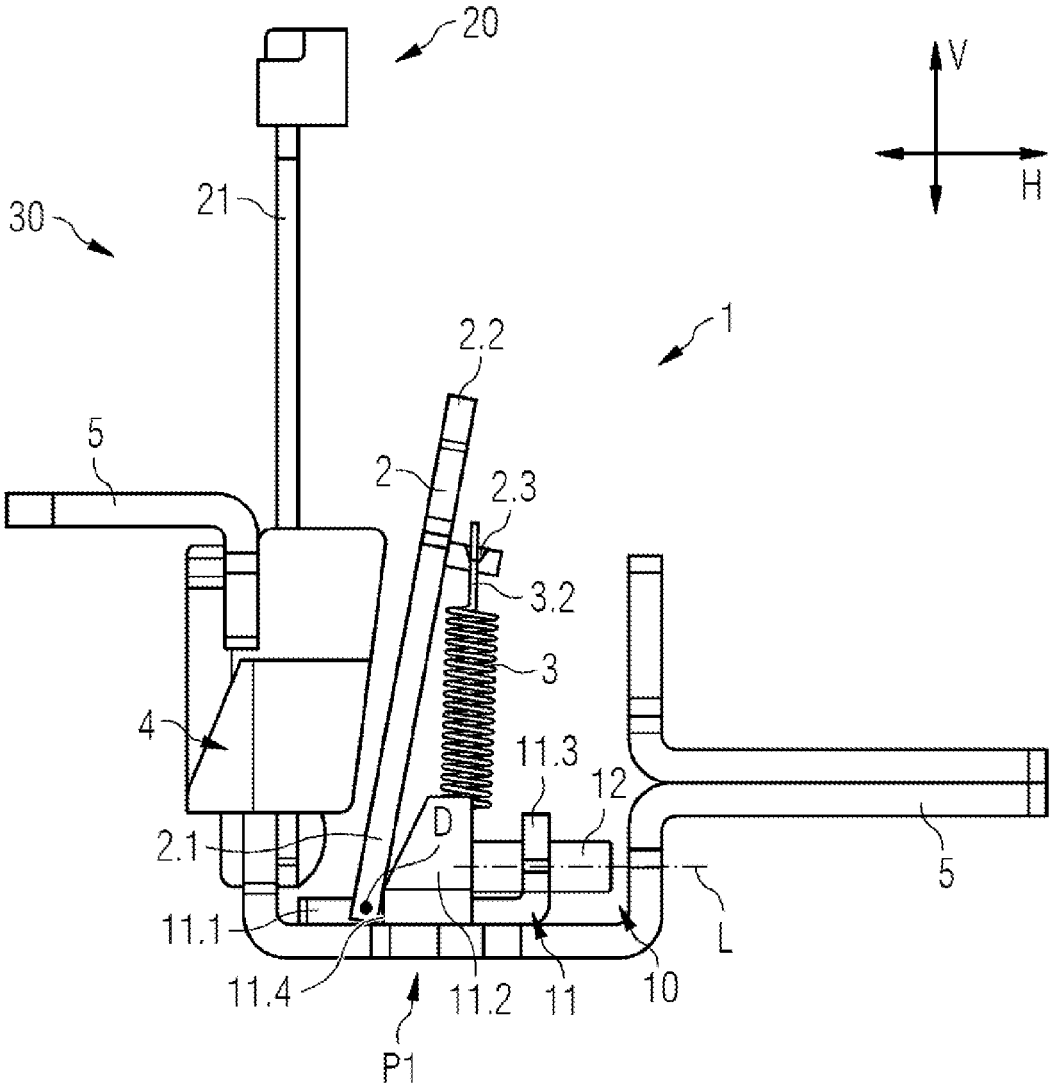
FIG. 3 shows a side view of the embodiment illustrated in FIG. 2 of the overcurrent tripping device.

FIG. 3 shows a side view of the embodiment of the overcurrent tripping device 30 shown in FIG. 2. The yoke element 4 and in particular the yoke element clamps 4.1 and 4.2 have, in this lateral view, a trapezoidal configuration, wherein, in particular, the edge of the yoke element clamp 4.1 or 4.2 of the yoke element 4 extends at an angle or beveled, which edge is oriented in the direction of the armature element 2. Owing to the configuration or size and/or arrangement of the yoke element in the region of the current-conducting element 5, the armature carrier unit 10 is arranged in a first position P1 in the region of the current-conducting element 5.

Advantageously, the armature carrier unit 10 can be positioned variably in that region of the current-conducting element 5 which extends substantially in the horizontal direction H between the side limbs of the current-conducting element 5, as shown in FIG. 3. Conversely, the yoke element 4 itself is advantageously arranged in that region of the current-conducting element 5 which extends substantially, as shown in FIG. 3, in the vertical direction V and consequently represents a side limb of the U-shaped current-conducting element 5 of the overcurrent tripping device 30.

The adjusting element 12 is also arranged in the adjusting element holding region 11.3 of the armature holding element 11 in such a way that the armature element 2 is positioned substantially at an angle with respect to the yoke element 4. The adjusting element 12 is therefore moved or shifted along the adjusting element longitudinal axis L away from the armature element 2 and in particular the spring element 3 in such a way that the first spring element end 3.1 of the spring element 3 is positioned in the direction of the adjusting element holding region 11.3 of the armature holding element 3, as a result of which, in turn, such a spring force acts on the spring element 3 that in particular the armature element 2 assumes a substantially angled position with respect to the yoke element 4.

Figure 4:
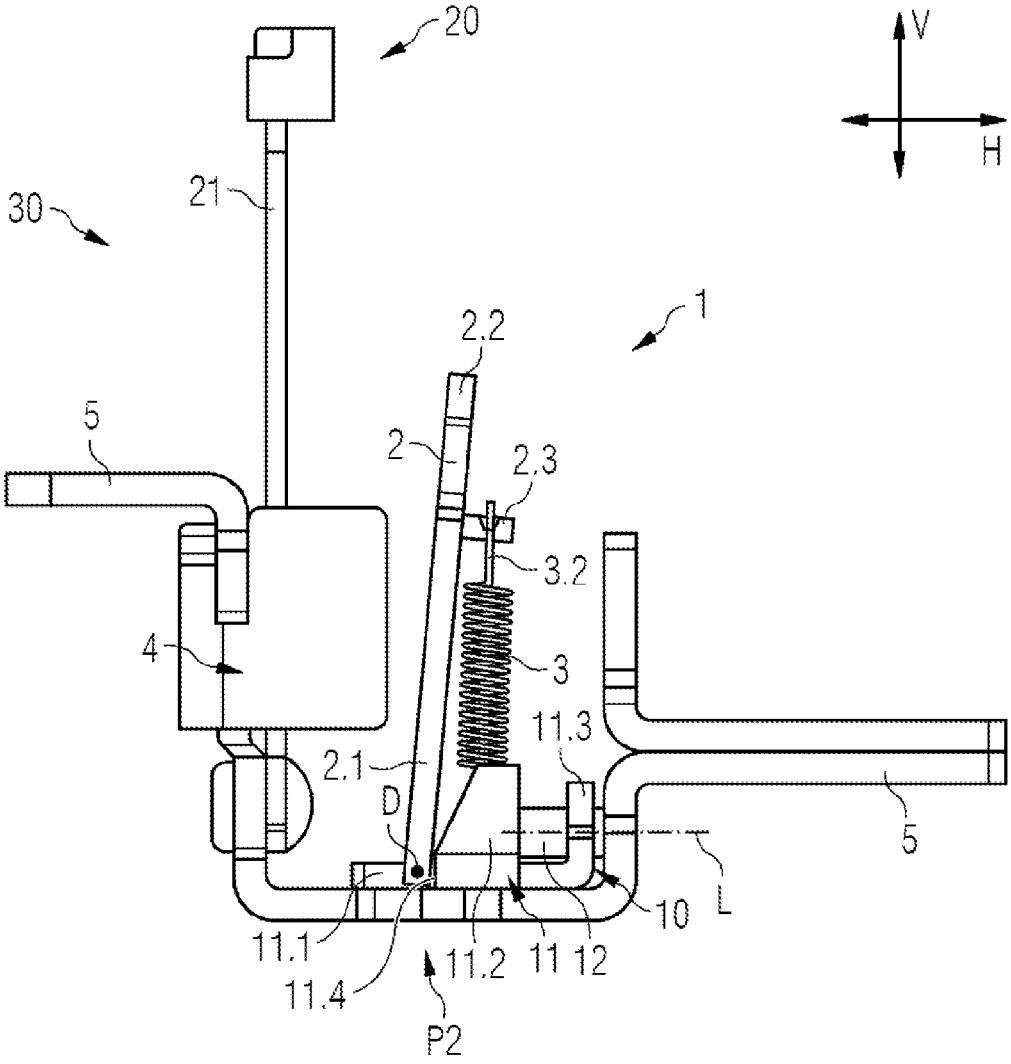
FIG. 4 shows a side view of a further embodiment of an overcurrent tripping device, having at least one embodiment of a magnetic tripping device.

Conversely, FIG. 4, which shows a further embodiment of an overcurrent tripping device 30, having a further embodiment of a magnetic tripping device 1, shows that the armature carrier unit 10 is arranged along the current-conducting element 5 in a second position P2 with respect to the yoke element 4 on the current-conducting element 5 and in particular in that region of the current-conducting element 5 which advantageously extends substantially at least partially in the horizontal direction H between the side limbs of the U-shaped current-conducting element 5. The second position P2 of the armature carrier unit 10 is therefore oriented so as to be spaced further apart from the yoke element than the first position P1 shown in FIG. 3.

This is in particular owing to the fact that the yoke element 4 of the embodiment shown in FIG. 4 has a different configuration or deviating configuration from the yoke element 4 of the embodiment shown in FIG. 3. Thus, in particular the yoke element clamps 4.1 and 4.2 of the yoke element 4 in the lateral illustration have a substantially square form, with the result that in particular the edges of the yoke element clamps 4.1 and 4.2 which are oriented in the direction of the armature element 2 extend substantially in the vertical direction V. In order therefore to avoid contact between the armature element 2 and the yoke element 4, it is accordingly advantageously possible to arrange the armature carrier unit 10 further removed from the yoke element 4 along the current-conducting element 5.

Furthermore, FIG. 4 shows an adjustment of the adjusting element 12 in such a way that the adjusting element 12 has been moved or shifted along the adjusting element longitudinal axis L in the direction of the armature element 2 and in particular of the stop region 11.2 of the armature holding element 11. As a result, the first spring element end 3.1 of the spring element 3 has therefore also been positioned in the direction of the armature element 2. Owing to this positioning, the armature element longitudinal axis extends substantially in the vertical direction V, in comparison with the extent of the armature element longitudinal axis as shown in FIG. 3, with the result that, in particular in comparison with the orientation of the armature element 2 as shown in FIG. 3, the armature element 2 in FIG. 4 is oriented virtually at right angles to the base region 11.1 of the armature holding element 11.

Advantageously, the armature holding element 11 and also the adjusting element 12 and consequently the entire armature carrier unit 10, as shown in FIGS. 2 to 4, comprise a nonmagnetic material, wherein it is additionally advantageously possible for the complete armature carrier unit 10 to consist of a nonmagnetic material, with the result that the formation of a second magnetic field which could negatively influence the first magnetic field of the yoke element 4 is avoided. Furthermore, owing to the adjustment of the spring force of the spring element 3 and/or the positioning of the armature element 2 with respect to the yoke element 4 in accordance with the way mentioned above, advantageously a reduction in the number of parts in respect of the variety of types of spring elements 3 that need to be used is possible, as a result of which manufacturing costs can be reduced and the product quality can be increased owing to more controlled fitting processes. Advantageously, therefore, the occurrence of errors owing to confusion as a result of different types of spring elements can be avoided thanks to the use of advantageously a single type of spring element.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a tangible computer readable medium and is adapted to perform any one of the aforementioned methods when run on a computer device (a device including a processor). Thus, the tangible storage medium or tangible computer readable medium, is adapted to store information and is adapted to interact with a data processing facility or computer device to execute the program of any of the above mentioned embodiments and/or to perform the method of any of the above mentioned embodiments.

The tangible computer readable medium or tangible storage medium may be a built-in medium installed inside a computer device main body or a removable tangible medium arranged so that it can be separated from the computer device main body. Examples of the built-in tangible medium include, but are not limited to, rewriteable non-volatile memories, such as ROMs and flash memories, and hard disks. Examples of the removable tangible medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SYMBOLS

1 Magnetic tripping unit
2 Armature element
2.1 First armature element end
2.2 Second armature element end
2.3 Engagement region of armature element
3 Spring element
3.1 First spring element end
3.2 Second spring element end
4 Yoke element
4.1,4.2 Yoke element clamp
5 Current-conducting element
10 Armature carrier element
11 Armature holding element
11.1 Base region of armature holding element
11.2 Stop region of armature holding element
11.3 Adjusting element holding region of armature holding element
11.4 Bearing region of armature holding element
12 Adjusting element
20 Thermal trip unit
21 Bimetallic element
30 Overcurrent tripping device
100 Magnetic trip unit
101 Armature element
101.1 First armature element end
101.2 Second armature element end
102 Spring element
102.1 First spring element end
102.2 Second spring element end
103 Yoke element
103.1,
103.2 Yoke element clamp
103.4 Cutout
103.5 Hook-like projections
104 Crosspin
H Horizontal direction
L Adjusting element axis/adjusting element longitudinal axis
P1 First position of armature carrier unit
P2 Second position of armature carrier unit
V Vertical direction

What is claimed is:

1. A magnetic tripping device of an electrical switch for interrupting a current flow in an electrical circuit in the event of the occurrence of a short circuit, the magnetic tripping device comprising:

at least one yoke element to generate a magnetic field depending on a current intensity of an electric current flowing through a current-conducting element;

an armature element, configured to respond movably to a changing magnetic field; and a spring element, configured to define a current threshold value for the movement of the armature element, wherein the armature element is arranged on an armature holding element that holds the armature element at a first armature element end, separated from the yoke element, via the first armature element end and is mounted pivotably about an armature element rotation axis, and wherein the armature holding element includes an adjusting element mounted thereon to interact with the spring element.

2. The magnetic tripping device of claim 1, wherein the adjusting element is an adjusting screw.

3. The magnetic tripping device of claim 1, wherein the armature holding element is variably positionable with respect to the yoke element.

4. The magnetic tripping device of claim 3, wherein at least the armature holding element comprises a nonmagnetic material.

5. The magnetic tripping device of claim 1, wherein at least the armature holding element comprises a nonmagnetic material.

6. An overcurrent tripping device of an electrical switch for interrupting a current flow in an electrical circuit in the event of the occurrence of an overload or a short circuit, the overcurrent tripping device comprising:

a thermal tripping device to interrupt the current flow in the event of an overload; and a magnetic tripping device to interrupt the current flow in the event of a short circuit, the magnetic tripping device being configured as claimed in claim 1.

7. An electrical switch, for interrupting a current flow in an electrical circuit in the event of the occurrence of an overload or a short circuit, comprising:

at least one overcurrent tripping device configured as claimed in claim 6.

8. The magnetic tripping device of claim 1, wherein the armature element is positionally adjustable relative to the at least one yoke element.

9. The magnetic tripping device of claim 1, wherein the armature element is mounted in a groove formed in a surface of the armature holding element.

10. The magnetic tripping device of claim 1, wherein the armature holding element has a stop extending substantially perpendicular from a base region of the armature holding element, the stop being between the armature element and the adjusting element.

11. A method for calibrating magnetic tripping of a magnetic tripping device of an electrical switch, comprising at least one of:

variably positioning an armature holding element, for rotatably mounting an armature element about an armature element rotation axis, taking into consideration at least one of an arrangement and configuration of a yoke element for generating a magnetic field, with respect to the yoke element; and moving an adjusting element mounted on the armature holding element for rotatably mounting an armature element about the armature element rotation axis, along an adjusting element axis, with the result that at least one position of at least one spring element end of a spring element connected to the adjusting element is varied in order to set a current threshold value.

12. The method of claim 11, a magnetic tripping device is used.

* * * * *